US005636531A

United States Patent [19]

Miller

[11] Patent Number: 5,636,531

[45] Date of Patent: Jun. 10, 1997

[54] FINGER RING ADJUSTMENT DEVICE

[76] Inventor: Bryan J. Miller, 875 N. Ridgewood Ave., Ormond Beach, Fla. 32174

[21] Appl. No.: 282,954

[22] Filed: Jul. 29, 1994

[51] Int. Cl.[6] ..... A44C 9/02

[52] U.S. Cl. ..... 63/15.6; 63/15.7

[58] Field of Search ..... 63/15.5, 15.6, 63/15.65, 15.7

[56] References Cited

U.S. PATENT DOCUMENTS

| | | | |
|---|---|---|---|
| 274,193 | 3/1883 | Henrich . | |
| 1,075,673 | 10/1913 | Segman . | |
| 3,150,505 | 9/1964 | Olson | 63/15.6 |
| 3,360,959 | 1/1968 | Schechter et al. | 63/15.6 |
| 3,465,544 | 9/1969 | Tucker | 63/15.6 |
| 3,483,718 | 12/1969 | Lodrini | 63/15.6 |
| 3,590,598 | 7/1971 | Leone | 63/15.6 |
| 3,603,109 | 9/1971 | Virtanen | 63/15.6 |
| 4,215,556 | 8/1980 | Mroz | 63/15.6 |
| 4,526,016 | 7/1985 | Cercone | 63/15.6 |
| 5,253,491 | 10/1993 | Buontempo et al. | 63/15.6 |

*Primary Examiner*—Michael J. Milano

*Attorney, Agent, or Firm*—Allen, Dyer, Doppelt, Milbrath & Gilchrist, P.A.

[57] ABSTRACT

A finger ring size opening adjustment device comprises a cradle which is extended from a first open position within the shank of a ring to second closed position reducing the ring size and permitting the wearer of the ring a sufficient size to easily slide over an enlarged knuckle or joint and to then be reduced to a desired fit on the phalanx portion of the finger. An extensible arm member provides the positioning of the cradle and is modified to provide various size ring openings. In one embodiment of the invention, a lever arm is rotatably connected to the cradle wherein the lever arm remains within the body of the shank while holding the cradle in its closed position. In alternate embodiments described, extensible members include telescoping set screws, a set screw and guide post, and a piston extended by pressurizing chamber about the piston. In each embodiment, the extensible mechanism remains within the boundaries of the shank permitting the ring having the adjustment device to be used in juxtaposition with a second or companion ring.

33 Claims, 4 Drawing Sheets

FINGER RING ADJUSTMENT DEVICE

BACKGROUND OF THE INVENTION

1. Field of the Invention

The present invention relates generally to a finger ring size opening adjustment device for enhancing the retention of a finger ring upon the wearer's finger and, more particularly to an adjustment device adapted to the ring shank for permitting passage of the ring over an enlarged knuckle for fitting a digital portion of the finger.

2. Description of Background Art

A well known problem in the fitting of finger rings is a condition where a wearer will have relatively large knuckles compared to the digital portion of his finger. If a ring is sized large enough to fit over the knuckle, it is typically too loose when it is pass the knuckle and as a result is not properly secured to the digital portion of the finger resulting in an objectionable loose fit. A variety of devices have been developed that include adjustable shanks and devices for filling space between the inner surface of the shank and the digital portion of the finger. U.S. Pat. No. 1,075,673 issued to A. Segman on Oct. 14, 1913 discloses a finger ring adjustable to different size fingers after the ring has been placed on the finger. In a preferred embodiment, a ring provided with a setting includes a base and a plurality of prongs adapted to receive a jewel. A screw threaded shank is secured to the base of the setting and is adapted to be received in a tapped opening in the ring. An adjustable plate is rotatably secured to an inner end of the screw threaded shank. A thumb screw used for adjusting the screw threaded shank is dimensioned to fit outside the shank within the head of the ring or extending outside the shank at a lower portion of the ring shank. U.S. Pat. No. 3,150,505 issued to C. A. Olson on Sep. 29, 1964 discloses a finger ring having an adjustable ring guard wherein the ring setting at the upper end of the ring is provided with a centrally located recess beneath the setting. This recessed portion is dimensioned to accommodate an eccentric wheel. The wheel is mounted on a journal which is rotatably received within a blind bore which extends transversely from one outer side of the ring through the recess. The journal at its outer portion is provided with a slotted end so as to enable its rotation and consequently the rotation of the eccentric wheel by means of a small screwdriver. As described, it is contemplated that the eccentric wheel is provided with a plurality of planes wherein each plane is spaced radially outward from the center of rotation at a greater distance than the previous plane. Upon rotation of the wheel by means of the turning of the journal, a plunger extending upwardly into the recess is forced downwardly causing a downward movement of a thin resilient metallic strip or band to which it is rigidly affixed in a conventional manner such as by welding. The flexible strip is semi-circular in configuration and is provided at each end with two outwardly extending tabs being of a size sufficient so as to engage about the inner half of the ring. The tabs prevent the accidental removal of the strip while at the same time allowing for a slight downward movement. Olson '505 further points out that the novelty resides in the provision of an adjustable ring guard wherein the adjustment is carried out by means of the eccentric wheel positioned within the recess provided generally beneath the setting and rotatable by means of journal extending therefrom to one side of the ring. Upon rotation of the eccentric, a plunger in contact therewith is forced downwardly thus causing the contraction of a resilient band slidably secured within the upper half of the inner periphery of the ring. Further, Olson teaches that a significant feature residing in the use of the eccentric wheel to maintain the resilient strip in contracted position resides in the fact that the ends of the strip need only be slidably engaged about the inner portion of the ring thus providing an entirely projection-free outer surface of the ring contrary to the manner in which many conventional, flexible, stripped ring guards requiring the complete encompassing of the ring portion so as to maintain them in the desired position. Olson does state that the only prerequisite be the availability of sufficient area so as to enable the provision of a relatively small recess for the reception of the eccentric wheel therein in a manner so as to enable the juxtaposition of the flexible strip with the inner surface of the ring when the strip is in its normally relaxed position such as would be required during the putting on of the ring. U.S. Pat. No. 3,483,718 issued to A. C. Lodrini on Dec. 16, 1969 discloses a device for narrowing the diameter of a finger ring which includes a short saddle-like insert fitted into the ring finger opening for constricting the opening size. The saddle comprises an inwardly or outwardly moveable arcuate sector or U-shaped cross section that fits around the bottom portion of the ring and with spring therebetween. The securement of the insert is effected by the engagement either of the ends of the insert with opposing notches in the inner edge of the ring adjacent the bottom portion or by the engagement of the ends of the leap spring with these notches. Adjustment is provided by controlling the spring pressure upon the finger. A shank is provided on the bottom of the ring to accommodate the sides of the insert which have flush sliding engagement therewith.

A number of adjustment devices include crescent shaped elements hinged to a bottom portion of the shank for pivoting from a first position outside of the ring opening to a second position within the ring opening thus providing the adjustment. In particular, U.S. Pat. No. 3,465,544 issued on Sept. 9, 1969 to D. R. Tucker discloses a ring having a hingably secured, crescent-shaped sizing element is hinged to a hinge shaft and pivoted into the ring to reduce the opening of the ring. The crescent-shaped member is snaplocked into the plane of the ring using a recess at an interior surface of the ring into which a correspondingly shaped portion of the crescent member is forcibly placed. U.S. Pat. No. 3,590,598 issued on Jul. 6, 1971 to Frank Leone discloses a finger ring with pivotally mounted size adjusting member actuated to reduce the internal ring size after the ring is on the finger so that a maximum ring opening can be provided for placing the ring on the finger. A spring biased detent holds the dimension-reducing element releasably in its full closed position and permits it to be swung under predetermined pressure to its full open position. The pivoted element is adapted to be swung to a position in the plane of the ring, thereby decreasing the ring size and to a position at right angles to the plane of the ring, thereby opening the ring to its full original inside diameter.

U.S. Pat. No. 4,215,556 issued on Aug. 5, 1980 to J. A. Moroz discloses a ring finger securement device used in conjunction with a finger ring for securing the ring upon the finger of the wearer wherein a size reducing element configured for fitting within the opening of the ring for interposition between an inner peripheral surface of the opening and a palmer surface of the finger. A hinge arrangement is provided for securement to an outer peripheral surface of the ring, there being an arm engaging the element and the hinge structure. The arm is pivotally secured with respect to the hinge structure to provide pivoting movement of the size reducing element between an open position, permitting unencumbered insertion of the finger within the opening, and a closed position wherein the size reducing element is located within the opening for substantially preventing the ring from being withdrawn from the finger.

Further, U.S. Pat. No. 4,526,016 issued on Jul. 2, 1985 to R. S. Cercone discloses a ring and sizing device with a push tab. The invention relates to a finger ring adapter device or bridge that will permit use by the wearer of a ring of a sufficient size to be easily slid over an enlarged knuckle or joint and to be thereafter reduced to a desired snug fit on the phalanx or digital portion of the finger. Cercone '016 discloses a hinged bridge which is mounted by a jeweler on a conventional ring in which will be a more refined and stable type of mounting from the standpoint that the bridge is hingably attached to the ring shank as opposed to removably attached. It is pointed out that an important factor in providing ring adjustments has been the need to provide a bridge that will be relatively inexpensive to produce and that can be provided in various sizes for ready adaptation to the wearer's requirements.

SUMMARY OF INVENTION

A finger ring size opening adjustment device comprises a cradle member having a generally convex surface dimensioned for mating with a generally concave inner surface of a ring shank portion. The ring shank portion has a generally concave inner surface for communicating with the ring shank generally concave inner surface. Means are provided for extending the cradle member from a first position wherein the cradle member is stored adjacent the shank portion inner surface within an annulus formed by the finger ring shank inner surface to a second position at a predetermined distance from the shank portion inner surface. The means includes an extensible shaft dimensioned to provide the predetermined distance. The first and second positions lie within an opening defined by a shank width and shank inner surface perimeter. The means further provides that the second position is confined within a perimeter defined by a shank outer surface perimeter thereby encompassing the means within a circumference of the shank defined by the shank outer surface.

In one embodiment, the extensible means comprises a lever arm having a central portion pivotally affixed within a shank portion cavity defined by shank portion side walls. The lever arm has an extensible arm portion extending from one side of the central portion. The extensible arm portion is pivotally affixed to the cradle member. The lever arm further has a fulcrum arm portion extending from the central portion opposing the extensible arm portion. The fulcrum arm portion is retractable into the cavity in the second position. A detent is placed within the fulcrum arm portion for communicating with a notch within the shank portion side wall for securing the lever arm in the second position. In an alternate embodiment, the extensible means comprises a threaded shaft member dimensioned to be received by a threaded bore in the shank portion. The bore passes from the shank portion inner surface to an outer surface. The shaft has a first end extending proximate the inner surface of the shank portion. A swivel element rotatably affixes the shaft first end to the cradle. Means for rotating the shaft for radially extending the shaft into a ring opening for positioning the cradle from the first to the second position in the opening is provided. In an alternate form, the threaded shaft comprises concentric telescoping set screws. The set screws have threaded outer surfaces and threaded bores dimensioned to communicate in extending the cradle from the first to the second position. In yet another embodiment, a post and hole combination is provided wherein the post extends away from the cradle to within a hole in the shank portion. The hole is dimensioned to closely receive the post. The post provides a guide to the cradle while the cradle moves from the first to the second position thereby keeping the cradle within the shank opening.

In yet another embodiment of the extensible means, a shaft is dimensioned to closely be received by a bore within the shank portion. An end of the shaft is rotatably affixed to the cradle. A valve cap is affixed over the bore at the shaft portion outer surface wherein the cap forms a pressure chamber with the bore walls and the shaft. The valve cap is dimensioned to receive a pump stem for injecting air within the chamber thereby extending the shaft in a piston-like fashion for moving the cradle from the first to the second position.

It is an object of the present invention to provide an adjustment to ring size allowing a comfortable fit on a digital portion of the finger while permitting easy passage of the ring over an enlarged knuckle. It is further an object to provide multiple adjustments to ring size for permitting a ring to be worn on various size fingers. To meet the needs in the marketplace, such an adjustment must be provided so that the side and outer walls of the ring shank are smooth enabling the ring to be worn in juxtaposition with a ring guard or companion ring. Further, it is necessary to avoid the need for a large shank or head of the ring for enclosing any adjustment mechanism. It is therefore a further object of the invention to provide a projection-free shank while the ring is being worn in its sized position. To further meet marketing demands, it is necessary that the adjustment device be inexpensive for the wearer and readily adaptable to the wearer's requirements.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
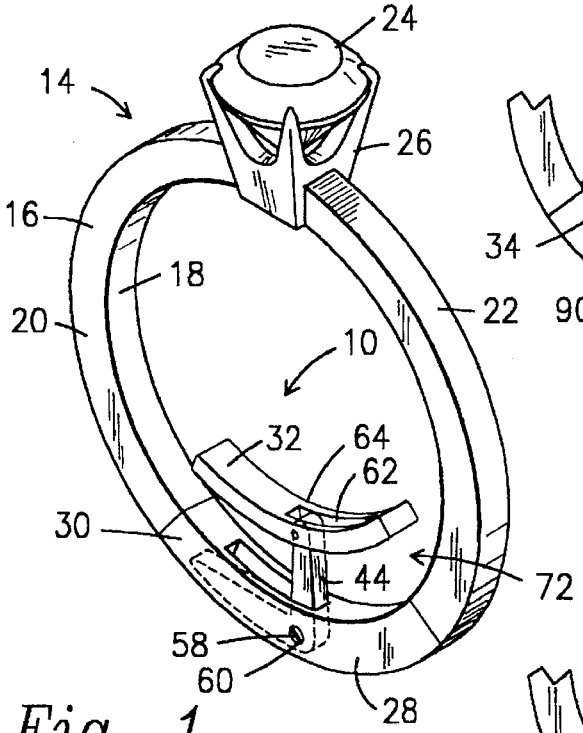
FIG. 1 is a perspective view of a ring illustrating an embodiment of the present invention in a closed position.
Figure 3:
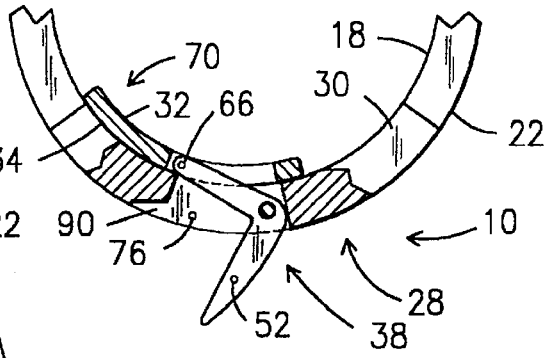
FIG. 3 is a partial cross-sectional side view of the present invention of FIG. 1 in an open position.
Figure 4:
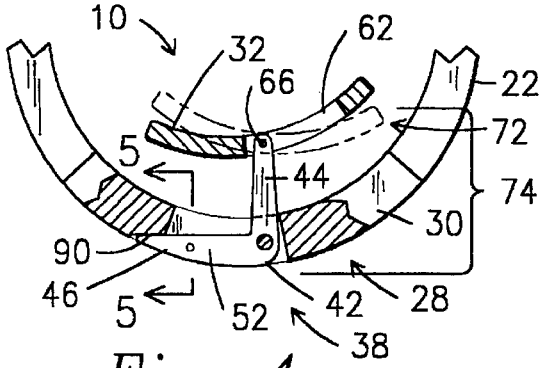
FIG. 4 is a partial cross-sectional side view of the present invention of FIG. 1 in the closed position.

A preferred embodiment of the present invention is described with reference to FIGS. 1 through 6 for a finger ring size opening adjustment device 10 made a part of a ring 14. As is typically described in the art, the ring 14 comprises a shank 16 having an inside diameter defined by a shank inner surface 18. The shank 16, by way of example, is further defined as having side wall surfaces 20 and an outer surface 22. With specific reference to FIGS. 1 and 2, the ring 14 further comprises a setting 24 affixed within a head 26.

The finger ring size opening adjustment device 10 is typically positioned within a shank portion 28 opposing the ring head 26 as illustrated in FIG. 1 and will be made a part of the shank 16 or a shank portion insert 30. In each embodiment of the present invention, an arcuate cradle 32 is provided. The cradle 32 has an outer surface 34 generally convex for mating with the shank inner surface is generally concaved. In the present invention, the cradle 32 has an inside surface 36 conforming to the general concave contour of the shank inner surface 18 for permitting a finger portion to comfortably rest within the cradle 32.

Figure 2:
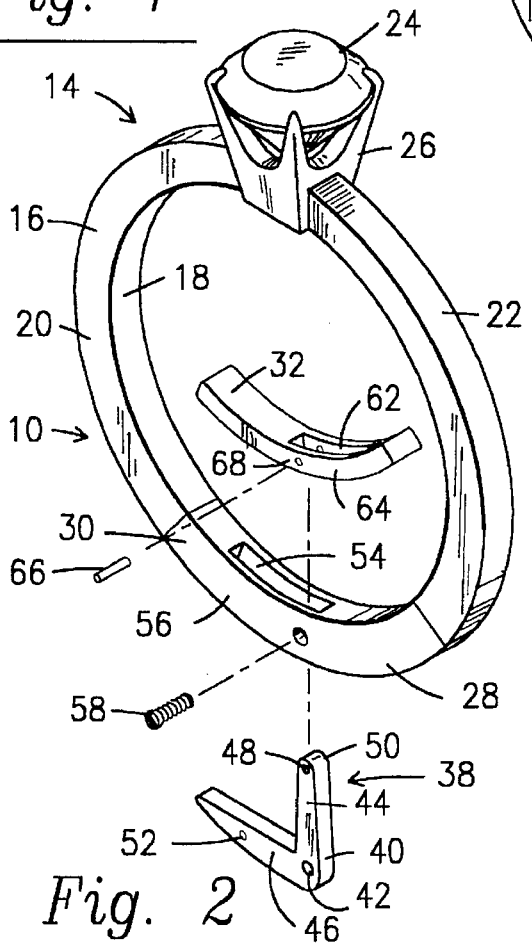
FIG. 2 is a perspective view of the embodiment of FIG. 1 illustrating the present invention in an exploded view.
Figure 5:
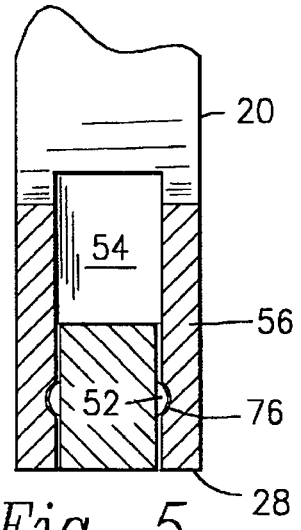
FIG. 5 is a partial cross-sectional view through a portion of the shank illustrated in FIG. 4.

As illustrated with reference to FIG. 2, the device 10 includes a lever arm 38 having a generally L-shape wherein a central portion 40 forms the angle of the L. A pivot hole 42 is provided within the central portion 40. An extensible arm portion 44 forms one leg of the L while a fulcrum arm portion 46 forms the other. A lever arm second pivot hole 48 is provided at an end 50 of the extensible arm opposing the central portion 40. As will be described later, the fulcrum arm portion 46 of the lever arm 38 has a detent 52 used to position the lever arm. Again with reference to FIG. 2, the shank portion 28 has a cavity 54 defined by shank side wall portions 56. The cavity 54 is dimensioned to closely receive the lever arm 38 for permitting the lever arm 38 to pivot about its central portion 40. A pivot screw 58 passes through threaded side wall holes 60 and through the lever arm pivot hole 42 in a journaled configuration for permitting rotation of the lever arm 38 about the pivot screw 58. The cradle 32 further comprises a cradle cavity 62 defined by cradle side wall portions 64. The cradle cavity 62 is dimensioned to closely receive the extensible arm portion 44 of the lever arm 38. A pivot pin 66 passes through pivot pin holes 68 and through the second pivot hole 48 of the extensible arm portion 44 for permitting rotation of the cradle 32 about the extensible arm end 50. With such an arrangement, and with reference to FIGS. 3 and 4, it is appreciated that the cradle 32 can be moved from a first or open position 70 wherein the cradle 32 mates with the shank inner surface 18 to a second or closed position 72 wherein the cradle 32 extends radially inward of the shank 16 by a distance 74 determined by the length of the extensible arm portion 44.

Again with reference to FIGS. 3 and 4, in the open position 70, the extensible arm portion 44 pivotally connected to the cradle 32 at the second pivot hole 48 rests within the cradle cavity 62 as the cradle outer surface 34 mates with the shank inner surface In this open position 70 the fulcrum arm portion 46 of the lever arm extends outward from the shank outer surface 22. In the closed position 72, the cradle 32 pivotally rotates about the pivot pin while the fulcrum arm portion 46 resides within the shank portion cavity 54. The fulcrum arm portion 46 is closely received by the cavity 54. In addition, the detent 52 within the fulcrum arm portion 46 is dimensioned to be received by a notch 76 within the shank side wall portions 56 as further illustrated with reference to FIG. 5.

Figure 6:
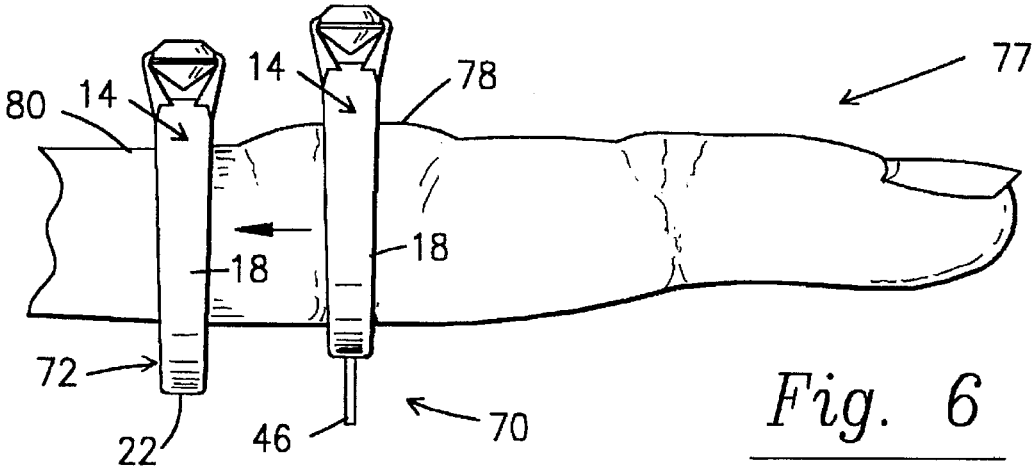
FIG. 6 is a partial view of a ring finger illustrating passage of the present invention illustrated in FIG. 1 from an open position passing over a knuckle of the finger to a closed position worn on a digital portion of the finger.

To further illustrate, and with reference to FIG. 6, a finger 77 having an enlarged knuckle 78 can receive the ring 14 wherein the knuckle 78 passes through the shank opening defined by the shank inner surface 18 while the device 10 is in its open position 70. Once the ring 14 passes over the knuckle and at a position typically at a phalanx portion of the finger 77, the device 10 is brought to its closed position 72 by rotating the fulcrum arm portion 46 into the cavity 54 permitting marriage of the detent and notch 76 for holding the cradle 32 within which the phalanx portion of the finger 80 now rests.

Figure 7:
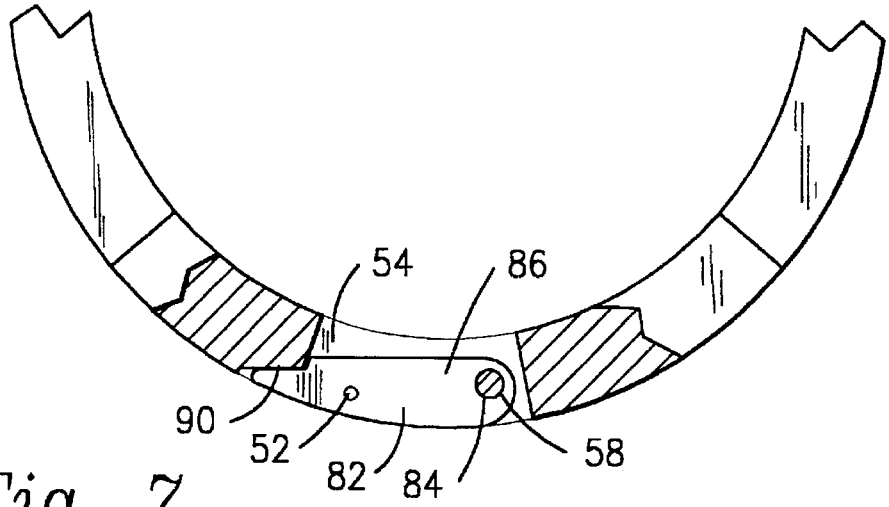
FIG. 7 is a partial cross-sectional side view of an insert used in combination with the embodiment of the present invention illustrated in FIG. 1.

As described earlier, it is anticipated that the device will be made with an original ring shank or inserted into the ring 14 as the insert 30 described earlier. In either case, there will be times when the ring 14 will be worn without the device 10. In such a circumstance, a plug or insert element 82 as illustrated with reference to FIG. 7 is used once the lever arm 38 and cradle 32 have been removed from the ring shank 16. In such a case, the pivot screw 58 is removed thereby permitting the lever arm 38 and cradle 32 to be removed. The insert element 82 is dimensioned as the fulcrum arm portion 46 and central portion 40 of the lever arm such that the pivot screw 58 passes through a hole 84 within a first end 86 of the insert element 82. The insert element 82 comprises a detent 52 as earlier described. In a preferred arrangement, both the insert element 82 and the fulcrum arm portion 46 of the lever arm 38 have their outer surfaces 88 and 46, respectively, conform to the contour of the shank outer surface 22 thereby providing a smooth transition over the outer surfaces. In addition, the ends of the fulcrum arm portion 46 and insert element 82 opposing the pivot screw 58 are dimensioned to rest against an offset or stop 90 defining a portion of the shank cavity 54 as illustrated in FIG. 7 and earlier referenced FIGS. 3 and 4.

As earlier described, the extensible arm portion 44 of the lever arm 38 determines the distance 74 that the cradle 32 will lie when the device 10 is in the closed position 72. The present invention meets its objectives by locating the cradle 32 from its first or open position 70 to its second or closed position 72 while maintaining the cradle within the confines of the shank 18. Specifically, the cradle 32 is dimensioned to lie within a cylinder defined by the shank side wall surfaces 20 and the shank inner surface 18. In addition, in the second or closed position wherein the ring 14 is typically worn at the phalanx portion of the finger 80 a uniform or smooth shank outer surface 32 is maintained. Meeting such an objective provides an adjustable ring that can be worn in Juxtaposition with a ring guard or companion ring (not shown) and worn without the concern for snagging clothing or other objects. The objects of the present invention are further met with the alternate embodiments as illustrated with reference to FIGS. 8, 9 and 10.

Figure 8:
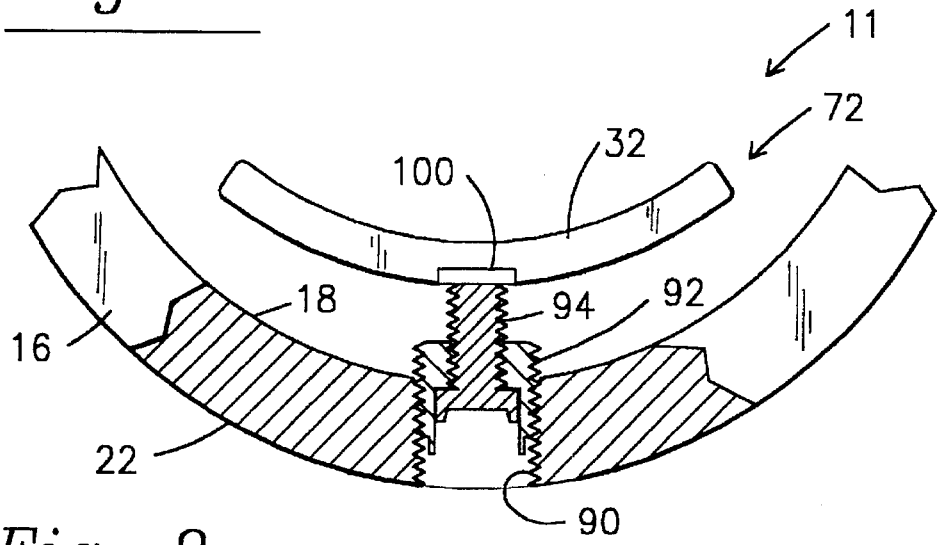
FIG. 8 is a partial cross-sectional view of an alternate embodiment of the present invention illustrating extensible concentric screw members.
Figure 9:
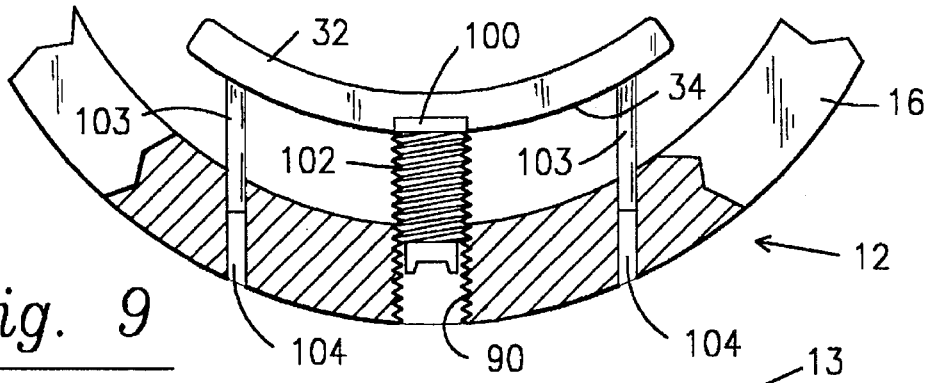
FIG. 9 is a partial cross-sectional side view of an alternate embodiment of the present invention using a single extensible screw and guide members.

With reference to FIG. 8, an alternate form of the device comprises a threaded bore 90 passing through the shank 16 from its inner surface 18 to its outer surface 22. Telescoping concentric set screws 92 are dimensioned to be received by the threaded bore 90. By way of example, a central set screw 94 communicates with an outer set screw 96 and are dimensioned to lie within the shank in the cradle open position 70 and extend radially into the shank opening to place the cradle 32 in its second or closed position The length of the set screws determine the extensible distance 74 as earlier described. The cradle 32 is rotatably affixed to an end 98 by a swivel element 100. It is anticipated that such an arrangement may be used wherein a single set screw replaces the telescoping concentric set screws With reference to FIG. 9, yet another form of the device comprises the threaded bore 90 within the shank 16 for receiving a set screw 102 having the swivel element 100. To enhance the stability of the cradle 32, guide posts 103 are affixed at one end to the cradle outer surface 34 and extend into guide post holes within the shank 16 dimensioned to closely receive the guide post 103. In the embodiment illustrated in FIG. 9, two guide posts are implemented and are placed cemetrically opposing each other on each side of the threaded bore 90.

Figure 10:
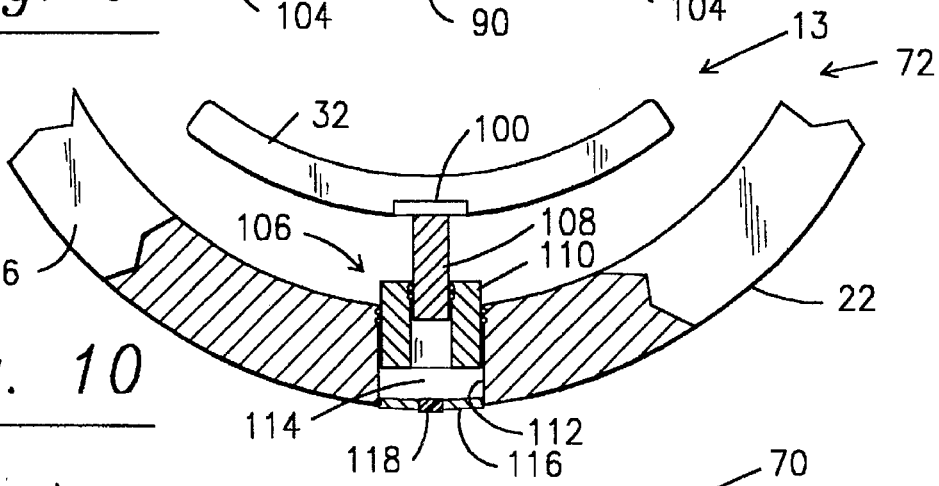
FIG. 10 is a partial cross-sectional side view of an alternate embodiment of the present invention illustrating the use of extensible piston members.

In a third alternate form of the device 13 as illustrated with reference to FIG. 10, a piston assembly 106 comprises a central piston 108 communicating with the bore of an outer piston wherein the outer piston is closely received by a bore 112 in the shank 16, sealable means (not shown) between the surface of the bore 112 and the pistons 108 and 110 form an air tight chamber 114 with a cap 116 sealably affixed to the shank outer surface covering the bore 112. A valve 118 provides access through the cap 116 into the chamber 114 for injecting air using an air pump (not shown) into the chamber 114 for causing the piston assembly 106 to be extended thus positioning the cradle 32 to its closed position 72.

Figure 8A:
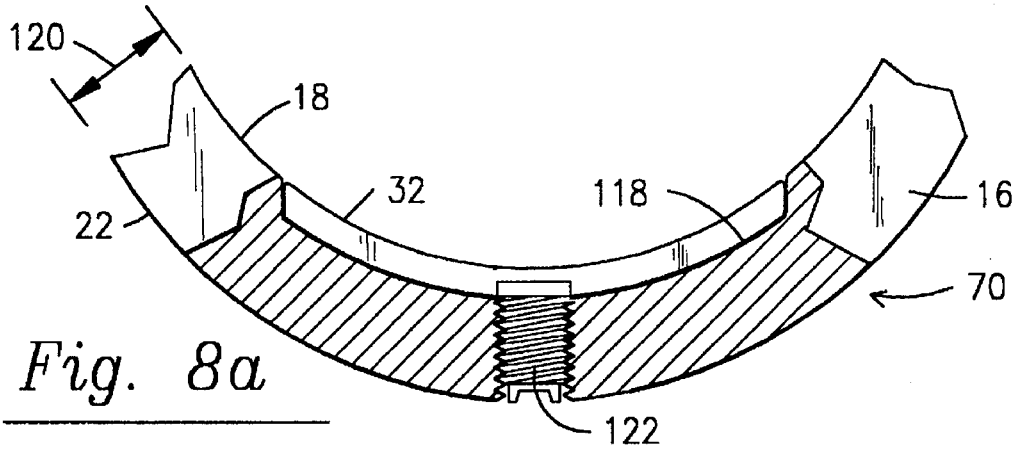
FIG. 8*a* is a partial cross-sectional view of the cradle recessed within the shank of an alternate embodiment of the invention illustrated in FIG. 8.
Figure 10A:
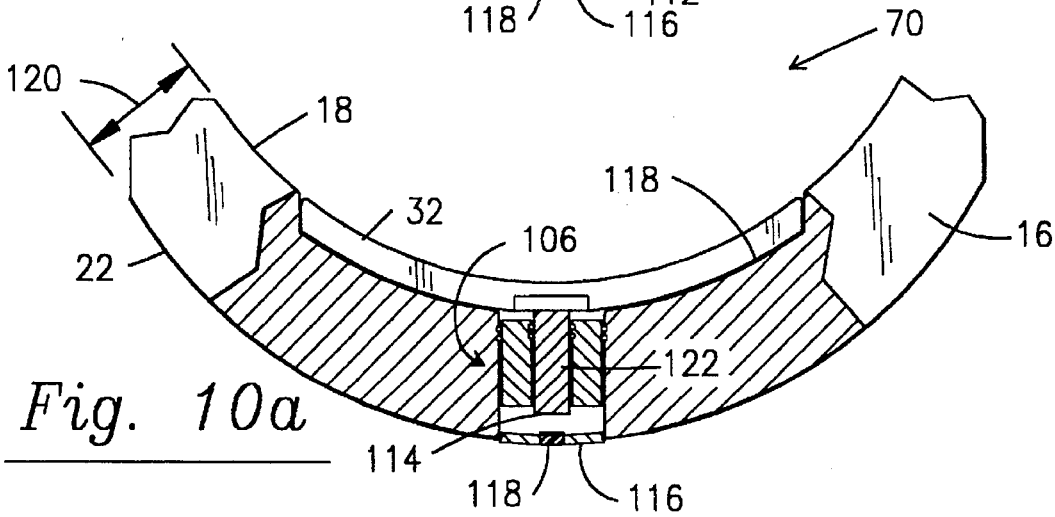
FIG. 10*a* is a partial cross-sectional view of the cradle recessed within the shank of an alternate embodiment of the invention of FIG. 10.

As illustrated by way of example with reference to FIGS. 8*a* and 10*a*, the cradle 32 in the open position 70 rests within a recess 118 formed within the inner surface 18 of the shank 16. The recess 118 is dimensioned to closely receive the cradle 32 as earlier described. Such an embodiment is used when a shank thickness 120 is sufficiently dimensioned to receive an extensible member 122 and the cradle 32 wherein the extensible member 122 is long enough to provide the needed change in ring size from the open position 70 to the closed position 72. The extensible members being the extensible arm portion 44 of the embodiment disclosed with reference to FIGS. 1 through 6 as well as the telescoping set screw 92, set screw 102, or piston assembly 106.

It is not unusual for the knuckle 78 to require a ring size of 12 in order for the ring 14 to receive the knuckle 78 on its way to the phalanx portion 80 requiring a size 5 ring. As illustrated with reference to FIGS. 11, 12 and 13, a ring sizer 124 is used to determine the appropriate ring size for the knuckle 78 and the phalanx portion 80. The ring sizer 124 comprises a shank 126 defining a ring size by its opening 128. A kit (not shown) includes by way of example, seventeen ring sizers 124 ranging from size 1 to size 17 in half size increments.

Figure 11:
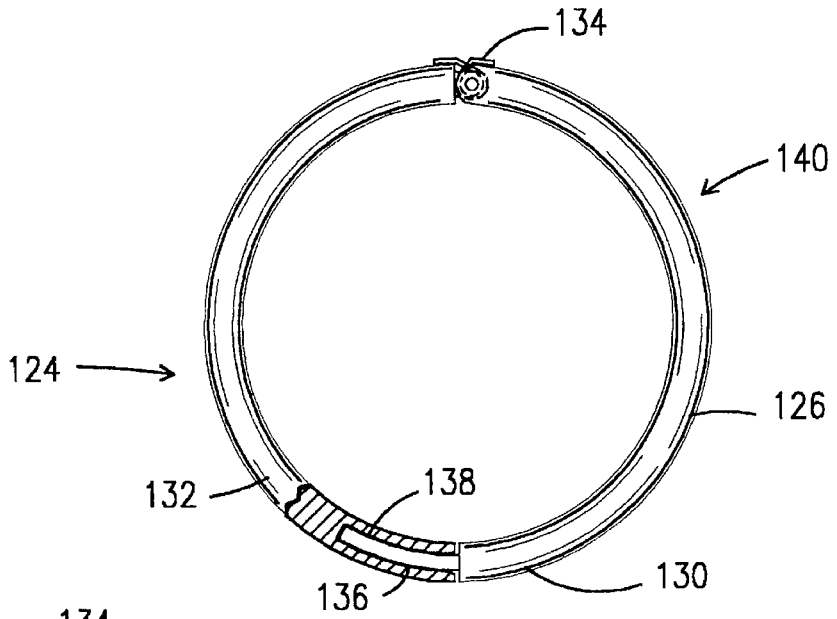
FIG. 11 is a partial cross-sectional side view of the ring sizer used in combination with the present invention.
Figure 12:
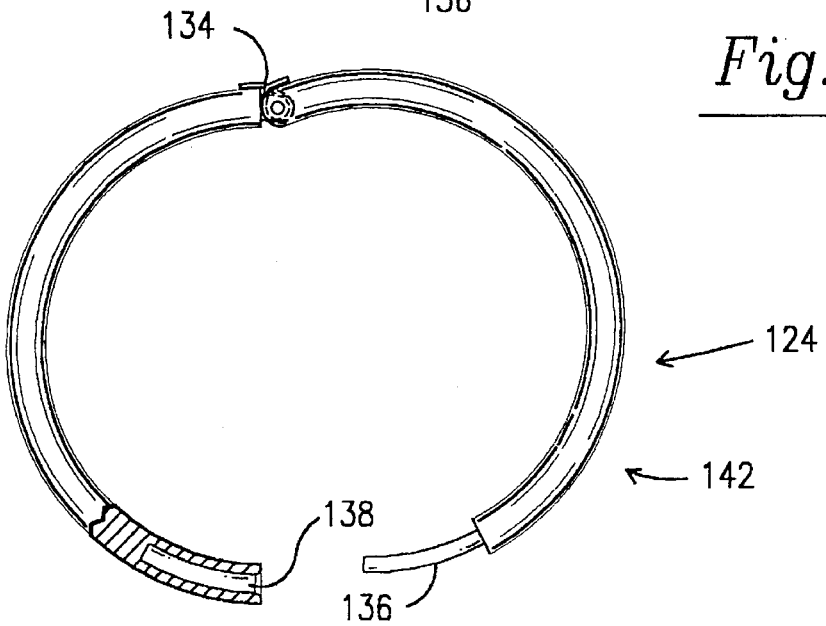
FIG. 12 is a partial cross-sectional side view of the ring sizer in FIG. 11 illustrated in a open position.
Figure 13:
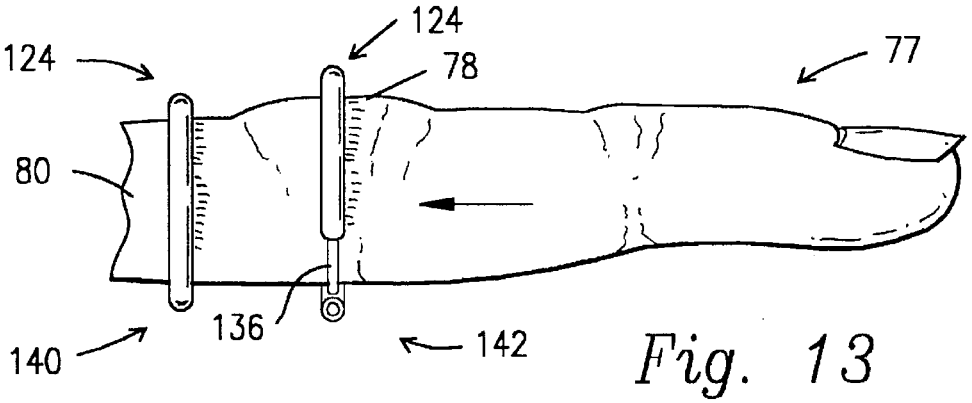
FIG. 13 is a partial side view illustrating the ring sizer in a first open position passing over a knuckle to a second position closed over a digital portion of the finger.

With reference to FIGS. 11 and 12, each ring sizer 124 comprises the shank 126 formed in two half portions 130 and 132. The shank half portions 130 and 132 are hingably connected by a spring hinge 134 communicated first ends of the shank portions 130 and 132 and a rod 136 extending from one shank portion 130 dimensioned to fit within a bore 138 in the end of the other half portion 132. In a closed position 140 as illustrated with reference to FIG. 11, the ring sizer 124 provides a specific ring size. By way of example, the small phalanx portion 80 of the finger 77 can then be measured with the ring sizer 124 by hingably opening the ring sizer 124 to an open position 142 illustrated with reference to FIG. 12 and slid over the knuckles 78 to the phalanx portion 80 as illustrated with reference to FIG. 13. With the ring sizer kit having the multiplicity of ring sizes, an accurate determination of that portion of the finger to which a ring must be fit can be made. Once the appropriate ring sizes have been determined the necessary ring size using the devices 10, 11, 12 and 13 in their open 70 and closed 72 positions can be determined and the appropriate extensible arms 44 and as earlier described can be established.

While various embodiments of the invention have been described in detail herein above, it is to be understood that various modifications may be made from the specific details described herein without departing from the spirit and scope of the invention as set forth in the appended claims. Having now described the invention, the construction, the operation and use of preferred embodiments thereof, and the advantageous new and useful results obtained thereby, the new and useful constructions, methods of use and reasonable mechanical equivalents thereof obvious to those skilled in the art are set forth in the appended claims.

What is claimed is:

1. A finger ring size opening adjustment device comprising:

a cradle member having a generally convex surface for mating with a generally concave shank portion inner surface;

a shank portion dimensioned for affixing within a finger ring shank, the shank portion having a generally concave inner surface for communicating with the ring shank generally concave inner surface, the shank portion further having a cavity for receiving a lever arm; and lever means for extending the cradle member from a first position wherein the cradle member is stored adjacent the shank portion inner surface to a second position at a predetermined distance from the shank portion inner surface, the lever means including a lever arm for providing the predetermined distance, the first and second positions placing the cradle member entirely within an opening defined by a shank width and shank inner surface, the lever means further confined fully within the shank outer surface when the cradle member is in the second position, the lever arm having a central portion pivotal within the cavity, the lever arm further having an extensible arm portion for moving the cradle member and a fulcrum arm portion extending from the central portion, the fulcrum arm portion fully retractable into the cavity when the cradle member is in the second position.

2. The device as recited in claim 1, wherein the lever arm further comprises a detent positioned within the fulcrum arm portion, the detent communicating with a notch within the shank portion side wall for securing the lever arm in the second position, the fulcrum arm portion having an end portion dimensioned to be received by a stop within the shank cavity for limiting rotation of the fulcrum arm portion through the shank cavity.

3. The device as recited in claim 1, wherein the cradle member further comprises a cavity dimensioned to closely receive the extensible arm portion, the arm portion pivotally mounted within the cavity thereby permitting a part of the arm portion to pivot into the cradle cavity while the cradle is in the first position adjacent the shank portion inner surface.

4. The device as recited in claim 1, wherein the shank portion is integrally formed with the shank of the ring.

5. The device as recited in claim 1, wherein the shank portion opposes a head of a ring, the head having a setting affixed thereto.

6. The device as recited in claim 1, wherein the cradle member comprises an arcuate shape, the cradle member having a concave shaped inner surface.

7. The device as recited in claim 6, further comprising the shank portion having a recess within an inner surface of the shank portion, the recess dimensioned for recieving the cradle while in the first position, the cradle arcuate shape cooperating with the ring shank concave inner surface for providing a smooth inner surface of the ring.

8. A finger ring having an adjustable ring size opening, the ring comprising:

a shank defining a generally circumferential shank inner surface, side wall surfaces and an outer surface, the shank inner surface and imaginary planes defined by the side walls collectively defining a shank opening;

a cradle member having an outer surface with a shape for mating with a portion of the shank inner surface; and means for extending the cradle member from a first position wherein the cradle member is stored adjacent the shank inner surface, to a second position at a predetermined distance away from the shank inner surface, the means including an extensible member for providing the predetermined distance, the first and second positions placing the cradle member entirely within the shank opening, the means further confined fully within the shank outer surface when the cradle member is in the second position, the shank outer surface defining a cylindrical surface.

9. The device as recited in claim 8, wherein the extensible member comprises a lever arm having a central portion pivotally affixed within a shank portion cavity defined by shank portion side walls, the lever arm having an extensible arm portion extending from one side of the central portion, the extensible arm portion pivotally affixed to the cradle member, the lever arm further having a fulcrum arm portion extending from the central portion opposing the extensible arm portion, the fulcrum arm portion fully retractable into the cavity in the second position.

10. The device as recited in claim 9, wherein the lever arm further comprises a detent positioned within the fulcrum arm portion, for communicating with a notch within the shank portion side wall and securing the lever arm in the second position.

11. The device as recited in claim 9, wherein the cradle member further comprises a cavity dimensioned to closely receive the extensible arm portion, the arm portion pivotally mounted within the cavity thereby permitting a part of the arm portion to pivot into the cradle cavity while the cradle is in the first position adjacent the shank portion inner surface.

12. The device as recited in claim 8, wherein the shank portion opposes a setting affixed to a head of the ring, the head extending beyond the shank outer surface.

13. The device as recited in claim 8, wherein the extensible means comprises:

a threaded shaft member dimensioned to be received by a threaded bore passing through the shank from the shank inner surface to the outer surface, the shaft having a first end proximate the inner surface in the first position, the shaft first end rotatably affixed to the cradle;

means for rotating the shaft for radially extending the shaft into the opening for extending the cradle from the first to the second position.

14. The device as recited in claim 13, wherein the threaded shaft comprises concentric telescoping set screws, the set screws having threaded outer surfaces and threaded bores dimensioned to communicate in extending the cradle from the first to the second position.

15. The device as recited in claim 13, further comprising a post having a first end affixed to the cradle, the post extending away from the cradle to within a hole in the shank dimensioned to closely receive the post for guiding to the cradle while moving from the first to the second position thereby keeping the cradle within the opening.

16. The device as recited in claim 15, further comprising a second post communicating with a second hole within the shank, the second post and second hole at an opposing side of the shaft from the post and hole.

17. The device as recited in claim 8, wherein the extensible means comprises:

a shaft dimensioned to be closely received by a bore within the shank, an end of the shaft rotatably affixed to the cradle; and a valve cap affixed over the bore at the shaft outer surface, the cap forming a pressure chamber with the bore and a shaft end portion, the valve cap having a pump stem for receiving fluid within the chamber thereby moving the cradle from the first to the second position.

18. The device as recited in claim 8, wherein the cradle member comprises an arcuate shape, the cradle member having a contour of a shank inner surface contour.

19. The device as recited in claim 18, further comprising the shank having a recess within a the inner surface dimensioned for receiving the cradle while in the first position, the cradle arcuate shape cooperating with the ring shank inner surface for providing a smooth annulus of the ring.

20. A ring finger size opening adjustment device comprising:

a cradle member having a convex surface dimensioned for generally mating with a concave inner surface of a ring shank portion;

a shank portion dimensioned for affixing within a finger ring shank, the shank portion having a concave inner surface for communicating with the ring shank concave inner surface, the shank portion having an opening defined by a shank width and shank inner surface, the shank portion further having a cavity for receiving a lever arm therein; and means for extending the cradle member from a first position wherein the cradle member is stored adjacent the shank portion inner surface within an annulus formed by the finger ring shank inner surface to a second position at a predetermined distance from the shank portion inner surface, the means including a lever arm having a central portion pivotally affixed within the shank portion cavity, the lever arm further having an extensible arm portion for moving the cradle member between the first and second positions, the lever arm further having a fulcrum arm portion extending from the central portion opposing the extensible arm portion, the fulcrum arm portion fully retractable into the cavity when the cradle member is in the second position, the cradle member lying within the shank opening in the first and second positions, the means confined within the shank outer surface perimeter when the cradle member is within the second position, thereby encompassing the means within a circumference of the shank defined by the shank outer surface.

21. The device as recited in claim 20, wherein the shank portion is integrally formed with the shank of the ring.

22. The device as recited in claim 20, wherein the shank portion opposes a head of a ring, the head having a setting affixed thereto.

23. A finger ring having an adjustable ring size opening, the ring comprising:

a shank defined by a generally circumferential inner surface, side wall surfaces and an outer surface, the inner surface defining an annulus, the inner surface and imaginary planes passing through the side walls further defining a shank opening, the shank further having a cavity for receiving a lever arm portion;

a cradle member having an outer surface dimensioned for mating with a portion of the shank inner surface; and means for extending the cradle member from a first position wherein the cradle member is stored adjacent the shank portion within the annulus, to a second position within the opening away from the shank inner surface, the means including a lever arm having a central portion pivotally affixed within the shank cavity, the lever arm having an extensible arm portion extending from one side of the central portion, the extensible arm portion for moving the cradle member between the first and second positions, the lever arm further having a fulcrum arm portion extending from the central portion opposing the extensible arm portion, the fulcrum arm portion fully retractable into the cavity when the cradle member is in the second position, the first and second positions placing the cradle member within the opening, the means confined within the shank outer surface when the cradle member is in the second position, thereby encompassing the means within a perimeter defined by the shank outer surface.

24. The device as recited in claim 23, wherein the cradle member extending means opposes a shank setting portion at a head of the ring.

25. A finger ring size opening adjustment device comprising:

a cradle member having a convex surface dimensioned for mating with a concave inner surface of a ring shank portion;

a shank portion dimensioned for affixing within a finger ring shank, the shank portion having a concave inner surface for communicating with the ring shank concave inner surface, the shank portion having an opening defined by a shank width and shank inner surface, the shank portion further having a cavity for receiving a lever arm; and means for extending the cradle member from a first position wherein the cradle member is stored adjacent the shank portion inner surface within an annulus formed by the finger ring shank inner surface to a second position at a predetermined distance from the shank portion inner surface, the means including a lever arm having a central portion pivotally affixed within the cavity, the lever arm having an extensible arm portion extending from one side of the central portion, the extensible arm portion pivotally affixed the cradle member, the lever arm further having a fulcrum arm portion extending from the central portion opposing the extensible arm portion, the fulcrum arm portion fully retractable into the cavity in the second position, the cradle member lying within the opening in the first and second positions, the means confined within the shank outer surface, thereby encompassing the means within a shank perimeter defined by the shank outer surface.

26. The device as recited in claim 25, wherein the lever arm further comprises a detent positioned within the fulcrum arm portion, the detent communicating with a notch within the shank portion side wall for securing the lever arm in the second position, and the fulcrum arm portion has an end portion dimensioned to be received by a stop within the shank cavity for limiting rotation of the fulcrum arm portion through the shank cavity.

27. The device as recited in claim 25, wherein the cradle member further comprises a cavity dimensioned to closely receive the extensible arm portion, the arm portion pivotally mounted within the cavity thereby permitting a part of the arm portion to pivot into the cradle cavity while the cradle is in the first position adjacent the shank portion inner surface.

28. The device as recited in claim 25, wherein the shank portion is integrally formed with the shank of the ring.

29. The device as recited in claim 25, wherein the shank portion opposes a head of a ring, the head having a setting affixed thereto.

30. A finger ring having an adjustable ring size opening, the ring comprising:

a shank defined by a generally circumferential inner surface, side wall surfaces and an outer surface, the inner surface defining an annulus, the inner surface and imaginary planes passing through the side walls further defining a shank opening, the shank further having a cavity for receiving a lever arm portion;

a cradle member having an outer surface dimensioned for mating with a portion of the shank inner surface; and means for extending the cradle member from a first position wherein the cradle member is stored adjacent the shank portion within the annulus, to a second position within the opening at a predetermined distance away from the shank inner surface, the means including a lever arm having a central portion pivotally affixed within the shank cavity, the lever arm having an extensible arm portion extending from one side of the central portion, the extensible arm portion pivotally affixed to the cradle member, the lever arm further having a fulcrum arm portion extending from the central portion opposing the extensible arm portion, the fulcrum arm portion fully retractable into the cavity when the cradle member is in the second position, the first and second positions placing the cradle member within the opening, the means confined within the shank outer surface when the cradle member is in the second position, thereby placing the means within the a shank perimeter defined by the shank outer surface.

31. The device as recited in claim 30, wherein the lever arm further comprises a detent positioned within the fulcrum arm portion, the detent communicating with a notch within the shank portion side wall for securing the lever arm in the second position.

32. The device as recited in claim 30, wherein the cradle member further comprises a cavity dimensioned to closely receive the extensible arm portion, the arm portion pivotally mounted within the cavity thereby permitting a part of the arm portion to pivot into the cradle cavity while the cradle is in the first position adjacent the shank portion inner surface.

33. The device as recited in claim 30, wherein the shank cavity opposes a shank setting potion at a head of the ring, the head extending beyond the shank outer surface.

* * * * *